United States Patent [19]

Henville

[11] 4,306,132

[45] Dec. 15, 1981

[54] ELECTRICAL SWITCHES

[75] Inventor: Michael I. Henville, Maidenhead, England

[73] Assignee: Unimax Switch Limited, Maidenhead, England

[21] Appl. No.: 139,297

[22] Filed: Apr. 11, 1980

[30] Foreign Application Priority Data

Apr. 27, 1979 [GB] United Kingdom ..... 14669/79

[51] Int. Cl.[3] ..... H01H 3/04

[52] U.S. Cl. ..... 200/332; 200/153 T

[58] Field of Search ..... 200/329, 330, 331, 332, 200/334, 335, 336, 337, 338, 340, 153 T, 153 G, 153 H, 293

[56] References Cited

U.S. PATENT DOCUMENTS

| | | | |
|---|---|---|---|
| 3,144,529 | 8/1964 | Zemke et al. | 200/67 D |
| 3,264,444 | 8/1966 | Krauss et al. | 200/332 |
| 3,382,339 | 5/1968 | Anderson | 200/67 B |
| 3,700,843 | 10/1972 | Resh | 200/332 |
| 3,809,837 | 5/1974 | Yoshioka | 200/332 |

*Primary Examiner*—John W. Shepperd

*Attorney, Agent, or Firm*—Scrivener, Clarke, Scrivener & Johnson

[57] ABSTRACT

Microswitches customarily have a casing assembly housing the switching mechanism, and an actuating button projecting from the casing. For some applications it is desirable to provide a pivotally mounted lever for depressing the button. Such lever has usually been secured in assembly of the casing.

To enable levers to be added as required to stocks of assembled switches, the lever 4 is pivotally mounted on a mounting block 5 which can be snap-fitted to the assembled casing 2 of a switch as required. The block comprises a spigot 6 which is received in a socket in the casing. Oppositely-facing knife-edges 10, 12 of the lever engage bearing faces 9, 11 of the block. A key-hole slot 13 allows the lever to be passed over a post 8 of the block, projecting head portions 14 of the post 8 retaining the lever after assembly with the block.

7 Claims, 9 Drawing Figures

ELECTRICAL SWITCHES

This invention relates to electrical switches, especially microswitches.

Microswitches generally comprise a casing of moulded plastics material in two parts, rivetted together, containing the contacts and the moving parts of a switching mechanism, and an actuating button projecting from the casing. It is common to provide an optional actuating lever which is pivoted at one end to the casing and of which an intermediate part bears on the button.

A usual way of mounting the lever has been to provide ears on it, engaging in recesses moulded into the two parts of the casing, so that the lever becomes trapped in the casing as the two parts are assembled together. This has the advantage of simplicity but it also has certain drawbacks.

First, it means the fulcrum about which the lever pivots is within the main body of the casing, and tends to mean therefore that the fulcrum is offset from the general line of the lever; it would be geometrically more satisfactory for the pivotal axis to be on a projection of a line joining the point of contact with the button and the point of engagement of the actuating end of the lever.

A second drawback is that any inaccuracy in the alignment of the two parts of the casing puts the recesses for the two ears out of alignment with one another and leads to the lever itself therefore being misaligned.

Third, it is a mechanically poor way of forming a pivot to have ears, stamped from the metal sheet of the lever, and therefore of essentially rectangular cross-section, turning in round holes.

Finally there is the question of stocks. The basic form of button-actuated switch is made in very large quantities and it would be advantageous not to have to stock the various sizes of completed lever-operated types as well but to be able to make up the lever-actuated types as required, stocking therefore standard button-actuated switches plus a range of levers.

The aim of the invention is therefore to overcome these drawbacks and allow the lever to be mounted on the casing in a better way.

According to the invention an electrical switch comprises a casing assembly which houses a switching mechanism of the switch, an actuating button which projects from the casing assembly, and an actuating lever which is pivotally mounted on mounting means secured to the casing assembly, for pivotal movement of the lever to depress the button to actuate the switch, the casing assembly and the mounting means being arranged for securement of the mounting means to the casing assembly after the casing assembly has been assembled in manufacture of the switch.

The mounting means is preferably arranged so that the fulcrum point of the lever is at the same level above a straight top surface of the casing assembly as the tip of the button, so that the fulcrum point, the point of engagement of the lever on the button, and the actuated end of the lever can lie in a substantially straight line with use of a straight lever parallel to the top surface.

In a preferred arrangement the casing assembly, the mounting means and the lever are arranged for mounting of the lever on the mounting means, in manufacture of the switch, before the mounting means is secured to the casing assembly, the lever becoming secured against removal from the mounting means upon securing the mounting means to the casing assembly.

Any suitable arrangement can be employed for securing the mounting means to the casing assembly, but in a preferred arrangement the mounting means comprises a shank portion received in an aperture in the casing assembly. The shank portion may comprise a resiliently mounted detent portion to prevent withdrawal of the shank portion from the aperture.

The lever is preferably pivotally mounted by means of a knife-edge portion of the lever engaging a bearing face of the mounting means. More preferably, oppositely-facing knife-edge portions of the lever are arranged to engage oppositely-facing bearing faces of the mounting means, and a preferred form for the mounting means is one in which it comprises a middle portion presenting a first bearing face, and side portions positioned on opposite sides of the middle portion and presenting second bearing faces, the first bearing face being oppositely-facing to the second bearing faces. The side portions may be arranged to be resiliently deflected relative to the middle portion, in manufacture of the switch, to permit assembly of the lever with the mounting means, the side portions returning to an undeflected position to retain the lever. The middle portion can suitably comprise an upstanding post comprising laterally projecting head portions, the lever having a keyhole slot in it which allows it to be passed over the head portions in assembly of the lever with the mounting means; the lever is thereafter moved along its length relative to the mounting means, with the head portions overlying the lever, for securement of the lever.

The mounting means can conveniently be a one-piece moulding of a plastics material.

There now follows a description, to be read with reference to the accompanying drawings, of a microswitch which illustrates the invention by way of example.

Figure 1:
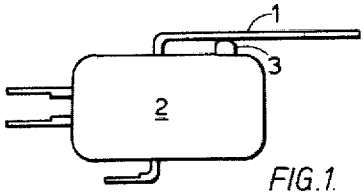
FIG.1. PRIOR ART
FIG. 1 is an elevation of a known microswitch.

In the known switch of FIG. 1 an actuating lever 1 is pivoted within a casing assembly 2 for pivotal movement to depress an actuating button 3 which projects from a straight top surface of the casing assembly. The casing assembly houses a switching mechanism of the switch. The pivot is formed by ears (not shown) on a down-turned end portion of the lever, received in round holes moulded in two halves of the casing.

Figure 2:
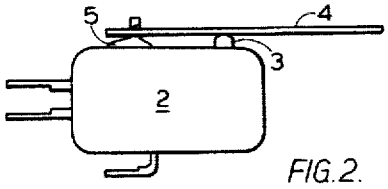
FIG. 2 is a view corresponding to FIG. 1 but showing a switch according to the invention.
Figure 3:
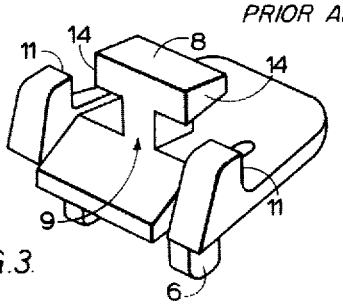
FIGS. 3 and 4 are respectively an isometric view and a plan view of a lever mounting block of the switch of FIG. 2.
Figure 4:
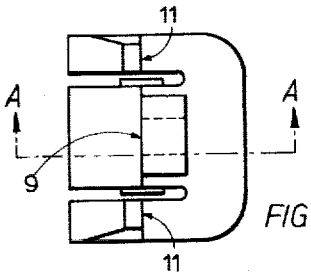
Figure 5:
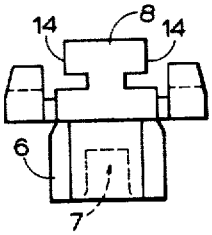
FIG. 5 is an end elevation of the block, looking from the left in FIG. 4.
Figure 6:
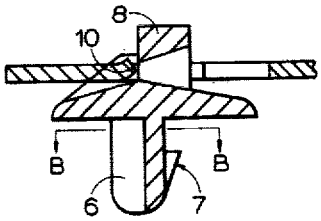
FIG. 6 is a section on the line A—A of FIG. 4, showing also the lever in position.
Figure 7:
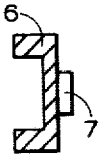
FIG. 7 is a section on the line B—B of FIG. 6.

In the switch shown in FIG. 2 a lever 4 is pivoted on mounting means in the form of a mounting block 5 (shown in more detail in FIGS. 3 to 7) which is separate from the casing assembly 2. The block, formed as a one-piece plastics moulding, comprises a shank portion in the form of a spigot 6 of channel-shaped cross-section (see FIG. 7). The spigot 6 is designed to be snap-fitted into an aperture in the assembled casing of the switch, being retained in the aperture by a resilient saw-tooth detent 7 of the spigot. A post 8 of a middle portion of the block has a bearing face 9 for engagement with a knife-edge portion 10 of the lever 4. Side portions of the block, positioned on opposite sides of the middle portion, present bearing faces 11 which are oppositely-facing to the face 9, and are arranged to be engaged by a pair of laterally spaced knife-edge portions 12 of the lever which are oppositely-facing to the knife-edge portion 10.

The knife-edge portion 10 is formed at the narrow end of a key-hole slot 13 in the lever, the slot 13 allowing the lever to be passed over the post in assembly of the lever with the block 5. Once the lever has been assembled onto the post 8 it is moved along its length relative to the block with laterally projecting head portions 14 of the post overlying the lever. The height of the side portions of the block 5, relative to the post 8, is such that they have to be flexed downwards slightly to allow the lever to be slid under the projecting portions 14 during assembly of the lever onto the block 5. The side portions can be resiliently deflected relative to the middle portion of the block, and return to an undeflected position to retain the lever 4 beneath the head portions 14 of the post. This flexing is only possible when the block is free, and once the block is fitted on to the casing assembly 2 the side portions are supported by the casing, so the lever 4 cannot be removed.

Figure 8:
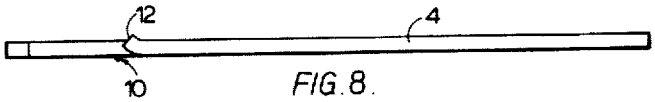
FIGS. 8 and 9 are respectively a side elevation and a plan view of the lever for fitting to the block any one of FIGS. 3 to 7.
Figure 9:
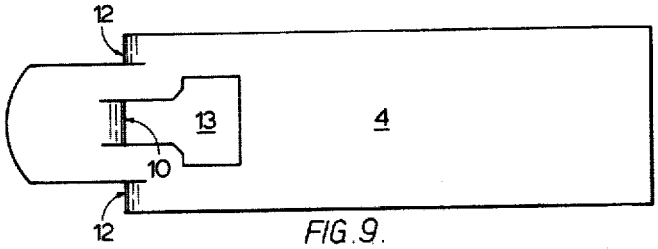

FIG. 8 shows how the knife-edges of the lever 4 are provided on the center-line of the thickness of the lever, by deformation of edge portions of the lever. Thus the pivotal axis of the lever is in the central plane of the straight lever.

Assembled button-actuated switches can be stocked separately from the block-mounted levers, and the levers, which may be of various lengths and forms, can quickly be fitted according to requirements. The knife-edge fulcrum arrangement ensures accurate alignment and virtually zero pivotal friction. Furthermore, by providing two (or possibly even more) alternative apertures or sockets in the casing one can provide a choice of positions for the block 5 and therefore a choice of leverages.

I claim:

1. An electrical switch comprising a casing assembly which houses a switching mechanism of the switch, an actuating button which projects from the casing assembly, and an actuating lever which is pivotally mounted on mounting means secured to the casing assembly, for pivotal movement of the lever to depress the button to actuate the switch, the mounting means being in the form of a mounting block comprising an upstanding post and side portions positioned on opposite sides of the post and the post presenting a first bearing face which is oppositely-facing to second bearing faces presented by the side portions, the post projecting through a slot in the lever and comprising laterally projecting head portions which overly the lever to retain the lever on the mounting block for pivotal movements against the bearing faces.

2. A switch according to claim 1 in which the mounting means comprises a shank portion received in an aperture in the casing assembly to secure the mounting means to the casing assembly.

3. The switch according to claim 2 in which said shank portion comprises a resiliently mounted detent portion which prevents withdrawal of the shank portion from the aperture.

4. A switch according to claim 1 in which the side portions are in the form of resiliently mounted arms and the lever has a key-hole slot in it which allows it to be passed over the head portions of the post, in assembly of the lever with the mounting block, and with deflection of the side arms to be moved along its length relative to the mounting block to a position in which the side arms can return to an undeflected position in which the lever is retained on the post beneath the head portions of the post.

5. A switch according to claim 4 in which with the mounting block secured to the casing assembly, the side arms lie closely adjacent the casing assembly, whereby the casing assembly prevents deflection of the side arms to prevent removal of the the lever from the mounting means.

6. A switch according to claim 1 in which the lever is pivotally mounted by means of co-linear knife-edge engagements between the lever and the oppositely-facing bearing faces of the mounting means.

7. A switch according to claim 6 in which said knife-edge engagements lie in a central plane of the lever.

* * * * *